US007259719B2

(12) United States Patent
Horie et al.

(10) Patent No.: US 7,259,719 B2
(45) Date of Patent: Aug. 21, 2007

(54) SURFACE-MOUNTED ANTENNA AND PORTABLE WIRELESS DEVICE INCORPORATING THE SAME

(75) Inventors: Ryo Horie, Tokyo (JP); Senzo Toyoda, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 55 days.

(21) Appl. No.: 10/620,438

(22) Filed: Jul. 17, 2003

(65) Prior Publication Data

US 2005/0259007 A1 Nov. 24, 2005

(30) Foreign Application Priority Data

Jul. 19, 2002 (JP) ..... P. 2002-211428

(51) Int. Cl.
*H01Q 1/24* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 5,886,668 A 3/1999 Pedersen et al. ..... 343/700 MS
5,969,680 A * 10/1999 Tsuru et al. ..... 343/700 MS
6,100,849 A * 8/2000 Tsubaki et al. ..... 343/702
2002/0047804 A1 4/2002 Ghosh et al. ..... 343/700 MS

FOREIGN PATENT DOCUMENTS

| | | |
|---|---|---|
| EP | 1 003 240 | 5/2000 |
| JP | 4-135007 U | 12/1992 |
| JP | 6-69715 | 3/1994 |
| JP | 11-340726 | 12/1999 |
| JP | 2001-7639 A | 1/2001 |

* cited by examiner

*Primary Examiner*—Michael C. Wimer
(74) *Attorney, Agent, or Firm*—Morgan, Lewis & Bockius, LLP

(57) ABSTRACT

A ground electrode is provided on a first surface of a dielectric body. A radiation electrode has a first end which is left open and a second end which is connected to the ground electrode. A feeding terminal is provided on the first surface. A feeding electrode has a first end which is connected to the feeding terminal and a second end which is connected to the ground electrode. At least a part of the feeding electrode is extended in parallel with an elongated direction of the radiation electrode, so as to excite the radiation electrode with an induction coupling in a non-contact manner.

6 Claims, 3 Drawing Sheets

SURFACE-MOUNTED ANTENNA AND PORTABLE WIRELESS DEVICE INCORPORATING THE SAME

BACKGROUND OF THE INVENTION

The present invention relates to a surface-mounted antenna which is suitably incorporated in a portable telephone, a portable wireless device or the like, and is small in size and may be directly mounted on a surface of a printed circuit board. More particularly, the invention relates to a surface-mounted antenna in which a feeding electrode is highly efficiently coupled to a radiation electrode by improving the electrical coupling of a feeding electrode with a radiation electrode, and a portable wireless device using the same.

A PIFA (planar inverted-F antenna), called an inverted-F antenna, and a forefront capacitive feeding inverted-L antenna are frequently used for the surface-mounted antenna of this type which may be reduced in size. The inverted-F antenna has the following structure as roughly sketched in FIG. 4. A conductive film is formed ranging from one main surface of a dielectric substrate 21 to a side surface thereof. A radiation electrode 22 is formed such that one end thereof is open, and the other end thereof, located closer to its side surface, is connected to a ground electrode 23 provided on the rear side of the dielectric substrate. A feeding pin 24 is connected to a feeding part 22*a*, which is located closer to its connection terminal connecting to a ground electrode 23, through a through-hole passing through the dielectric substrate 21 and the ground electrode 23.

The inverted-L antenna, as shown in FIG. 5, for example, is provided on a surface of a dielectric substrate 21 such that its radiation electrode 22 is confronted with a feeding electrode 24, and is capacitively coupled with the same. A ground electrode 23 is provided on the reverse side of the dielectric substrate 21. In the structure of the inverted-L antenna, the radiation electrode 22 is open at one end, and capacitively coupled with the feeding electrode 24, and connected at the other end to the ground electrode 23.

In each of those antennas, the radiation electrode is open at one end, while the other end is grounded, and has an electrical length of about $\lambda/4$ ($\lambda$=wavelength of the operation frequency). The radiation electrode is excited and operated in a resonance mode. The operation frequency (resonance frequency) of the antenna is determined mainly by an electrical length of the radiation electrode. Advantageously, the operation frequency is adjusted by adjusting the length of the radiation electrode substantially independently. An additional advantage is that in both types of antennas, the impedance matching for feeding to the radiation electrode is performed independently of the operation frequency.

In the inverted-F antenna, the radiation electrode is open at one end (maximum voltage) and grounded at the other end (zero voltage), and the radiation electrode is connected to the feeding pin at a point at which the impedance of the feeding pin is made coincident with the impedance of the radiation electrode, which is located closer to the ground terminal. Accordingly, in a case where the impedance at the feeding point to which the feeding pin is connected becomes different from that of the feeding pin as a result of the operation frequency adjustment of the radiation electrode, the necessity of moving the connection point occurs to change a connecting position of the feeder line. Accordingly, its continuous adjustment is difficult.

Also in the forefront capacitive coupling inverted-L antenna, a coupling gap is provided between the open end of the radiation electrode and the feeding electrode. Those are capacitor coupled with each other through the gap. Advantageously, in the inverted-L antenna, the impedance matching is carried out independently of the operation frequency adjustment, by adjusting the gap size. However, disadvantageously, in the inverted-L antenna, when the open end of the radiation element is moved in order to change the operation frequency of the radiation electrode, the gap size resultantly changes. Consequently, it is impossible to perform the impedance matching perfectly independently of the operation frequency adjustment.

A quantity of capacitance coupling theoretically depends on a dielectric constant and dielectric effects. Therefore, the coupling loss resulting from the dielectric loss inevitably occurs. This causes the antenna loss. Further, the capacitive coupling part is theoretically located at a maximum point of electric field. Accordingly, an electric field distributed around the capacitive coupling part interacts with a dielectric material present around the capacitive coupling part, and a coupling quantity tends to vary. As a result, the matching characteristic is apt to vary.

Further, the feeding electrode is open at the tip end (forefront) thereof. It exhibits a high impedance characteristic over a broad frequency range from frequencies lower than the operation frequency band to DC. Accordingly, the antenna is sensitive to incoming noise and static electricity, and is apt to impart load to the device installed with the antenna.

Additionally, theoretically, the coupling capacitance is sensitive to the coupling gap dimension. Accordingly, the matching characteristic is sensitive to a change of the gap dimension, and the matching characteristics of the products tend to vary at the stage of their manufacturing.

SUMMARY OF THE INVENTION

It is therefore an object of the present invention to provide a small-sized surface-mounted antenna in which the resonance frequency adjustment and the matching characteristic adjustment are independently carried out as in the inverted-F antenna or the capacitive coupling type antenna, while the defectives of the capacitive coupling type antenna are overcome. It is also an object of the present invention to provide a portable wireless device incorporating such a surface-mounted antenna.

In order to achieve the above objects, according to the invention, there is provided an antenna, comprising:

a dielectric body;

a ground electrode, provided on a first surface of the dielectric body;

a radiation electrode, having a first end which is left open and a second end which is connected to the ground electrode;

a feeding terminal, provided on the first surface; and a feeding electrode, having a first end which is connected to the feeding terminal and a second end which is connected to the ground electrode, at least a first part of the feeding electrode being extended in parallel with an elongated direction of the radiation electrode, so as to excite the radiation electrode with an induction coupling in a non-contact manner.

With such a configuration, a power feed signal input to the feeding terminal causes the current flowing into the ground electrode to be a maximum current at a grounding point (the second end of the feeding electrode). A magnetic field developed by the current induces current in the parts of the radiation electrode which is parallel to the feeding electrode.

Then, the radiation electrode is magnetically coupled to the feeding electrode and excited. The coupling is adjusted easily and independently of the operation frequency in a manner that the width of the feeding electrode is designed to be relatively wide, and a width of the coupling part of the feeding electrode to the feeding terminal is adjusted.

Preferably, an electrical length of the first part of the feeding electrode is substantially equal to one fourth of a wavelength at an operation frequency of the antenna.

With such a configuration, the induction coupling can be attained more sufficiently.

Preferably, a part of the feeding electrode extends in the vicinity of the first end of the radiation electrode so as to establish a capacitive coupling therebetween.

With such a configuration, the feeding electrode and the radiation electrode are coupled magnetically and capacitively, whereby a satisfactorily stable coupling is secured.

According to the invention, there is also provided a portable wireless device, comprising a circuit board, on which a wireless communication circuit is provided, and the above antenna is mounted.

According to the invention, by actively utilizing the induction coupling of the feeding electrode with the radiation electrode, the operation frequency adjustment and the matching adjustment are carried out independently carried out more easily than the inverted-F antenna and the forefront capacitive feeding inverted-L antenna. Further, the invention successfully overcomes the defects of the capacitive coupling, and provides a small-sized surface-mounted antenna with excellent performances and good stability. Accordingly, the antenna may easily be mounted on the portable wireless device the size reduction of which is required, such as a portable telephone. In this case, it functions as a high performance antenna.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Figure 1A:
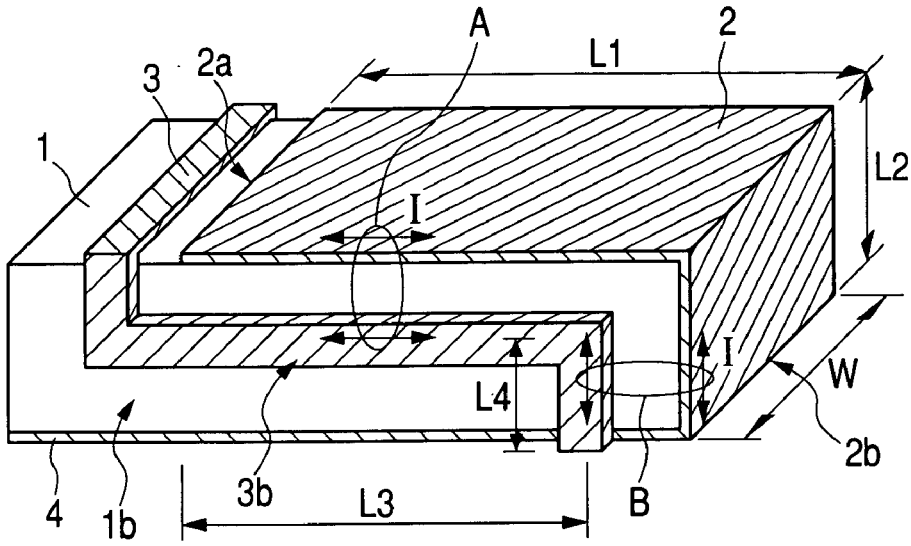
FIG. 1A is a top-side perspective view of a surface-mounted antenna according to a first embodiment of the invention.
Figure 1B:
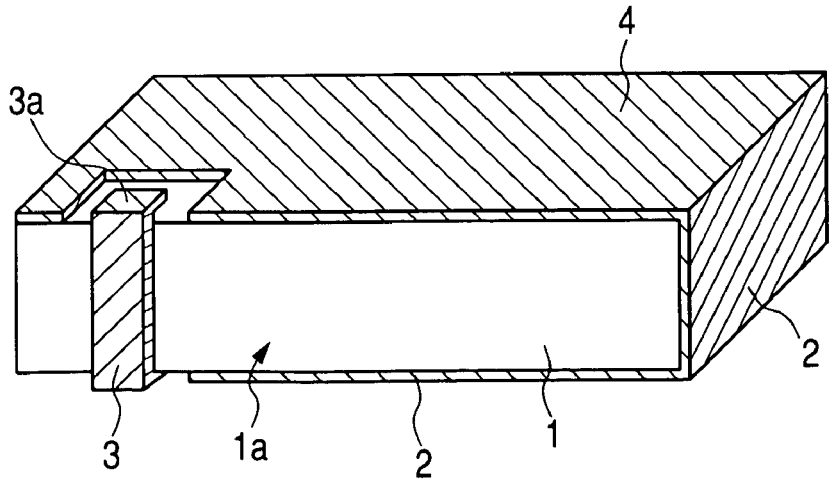
FIG. 1B is a bottom-side perspective view of the surface-mounted antenna of FIG. 1A.

Preferred embodiments of the present invention will be described with reference to the accompanying drawings. FIGS. 1A and 1B perspectively show the top and rear sides of a structure of an surface-mounted antenna according to a first embodiment of the invention. A ground electrode 4 is mainly provided on at least one surface of a dielectric substrate 1 made of a dielectric material. A radiation electrode 2, which is opened at one end and connected at the other end to the ground electrode 4, is provided in the dielectric substrate 1 or on a surface of the dielectric body. A feeding terminal 3*a* is provided on the surface of the dielectric body on which the ground electrode is formed in a state that it is separated from the ground electrode 4. A feeding electrode 3 for electrically interconnecting the radiation electrode 2 and the feeding terminal 3*a* is provided in the dielectric substrate 1 and/or on a surface of the same.

The feeding electrode 3 is connected at one end to the feeding terminal 3*a*, and at the other end to the ground electrode 4. The feeding electrode 3 is configured such that at least a part thereof extends parallel to an elongated direction of the radiation electrode 2. The parallel portion is inductively coupled with the radiation electrode 2 to excite the radiation electrode 2 in a non-contact manner.

Use of a material having a dielectric constant which is as large as possible is preferable for the dielectric substrate 1 since when such a material is used, the radiation electrode 2 may be reduced in size. Use of ceramics, such as $BaO—TiO_2—SnO_2$ or $MgO—CaO—TiO_2$, is preferable since a relative dielectric constant of about 30 or higher is secured. The dielectric substrate 1 may be formed as a unit body made of dielectric material, e.g., ceramics. Alternatively, it may be formed such that appropriate conductive films, such as ceramics sheets, are laminated and sintered. In another alternative, it may be formed such that glass epoxy films having conductive films are laminated. In the case of the antenna used for the Bluetooth communication, the dielectric body has the size of 12 mm (length)×4 mm (width)×3 mm (height) when the material has the relative dielectric constant of the material of about 30. When the relative dielectric constant of the material is about 8, the dielectric body has the size of any of approximately 15 mm×7 mm×6 mm to 15 mm×3 mm×2 mm. The length (vertical length of the dielectric body) is determined by a desired frequency band. The dielectric substrate 1 generally takes a shape of such a rectangular solid or a plate.

In this embodiment, the radiation electrode 2 having a width W substantially equal to that of the dielectric substrate 1 is formed on the surface of the dielectric substrate 1. It is preferable that the dielectric substrate 1 is wide since the wider the width W of the radiation electrode 1 is, the broader the band characteristic is. As will be described later with reference to FIG. 2, the width of the radiation electrode may be selected to be narrower than that of the dielectric substrate 1. A laminated structure consisting of the ceramics sheets may be employed for the dielectric substrate 1. In this case, the radiation electrode is embedded in the laminated structure, while it is not exposed on the surface of the dielectric body. One end of the radiation electrode 2 is open, while the other end extends on a side surface of the dielectric substrate 1 and is connected to the ground electrode 4 provided on the rear surface of the dielectric body. A length (measured in the elongated direction: L1+L2) from one end 2*a* to the other end 2*b* of the radiation electrode 2 is selected so as to provide an electrical length of about $\lambda/4$ at a desired frequency band. The electrical length is inversely proportional to the square root of a relative dielectric constant $\epsilon_r$ of the dielectric substrate 1 (proportional to $1/\epsilon_r^{1/2}$). The fact teaches that if the dielectric substrate 1 having a large dielectric constant is used, its physical length may be reduced.

The feeding electrode 3 magnetically couples the radiation electrode 2 to a feeding part for communication signals. In the instance shown in FIG. 1, the feeding electrode extends from the feeding terminal 3*a*, which is provided on the bottom surface of the dielectric substrate 1, and further it extends on one side surface 1*a* of the dielectric body and to the surface thereof having the radiation electrode 2 provided thereon. On a side surface 1*b* of the dielectric body that is opposed to the side surface 1*a*, the feeding electrode has a parallel portion 3*b* which is in parallel with the radiation electrode 2 as viewed in the elongated direction of the radiation electrode. A tip end of the radiation electrode is extended to the bottom surface of the dielectric substrate 1 and connected to the ground electrode 4. The parallel portion 3*b* magnetically couples the feeding electrode to the radiation electrode 2. The parallel portion has a length of about λ/4 (L3+L4) as measured from the open end 2*a* of the radiation electrode 2. With such a length, the feeding electrode 3 is magnetically coupled with the radiation electrode 2 in a sufficient coupling level, whereby the radiation electrode 2 is excited. If required, the length (L3+L4) may be shorter than λ/4.

In the instance shown in FIG. 1, the parallel portion 3*b* of the feeding electrode is provided on the side surface 1*b* of the dielectric body 1, which is different from the surface having the radiation electrode 2 provided thereon. However, the invention is not limited to this configuration.

Figure 2:
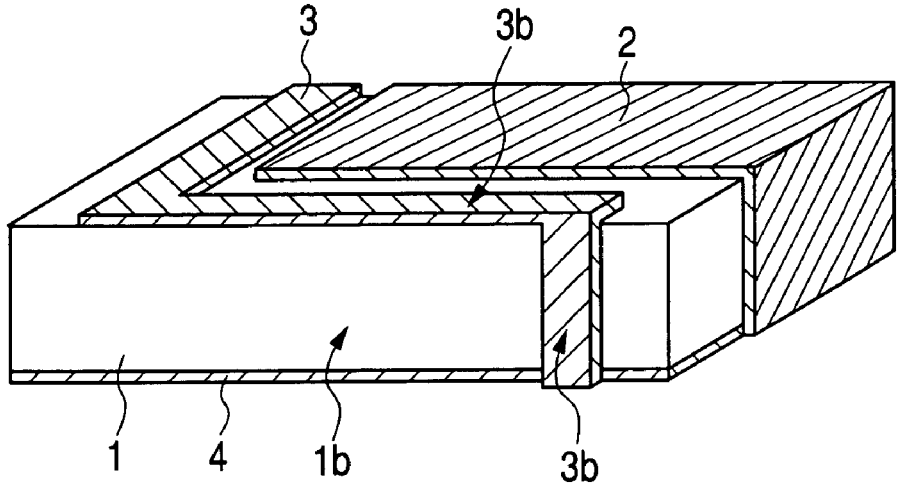
FIG. 2 is a perspective view of a surface-mounted antenna according to a second embodiment of the invention.

For example, as a second embodiment of the invention shown in FIG. 2, the radiation electrode 2 may not extend over the full width of the dielectric substrate 1, and a part of the feeding electrode 3 may be provided in parallel with the radiation electrode 2 on the surface having the radiation electrode formed thereon. In this embodiment, a part of the feeding electrode 3, which extends parallel to the radiation electrode 2 on the surface having the radiation electrode 2, and another part of the feeding electrode 3 which is formed on the side surface 1*b* of the dielectric substrate 1, serve as the parallel portion 3*b* to contribute the magnetic coupling of the feeding electrode 3 with the radiation electrode 2. The part of the feeding electrode 3 on this side surface 1*b* may also be provided on the same side surface (the right end face in FIG. 2) of the dielectric substrate 1 as the surface on which the radiation electrode 2 is formed. In FIG. 2, like or equivalent portions are designated by like reference numerals used in the first embodiment, and no further description on them will be given, for simplicity.

Figure 3:
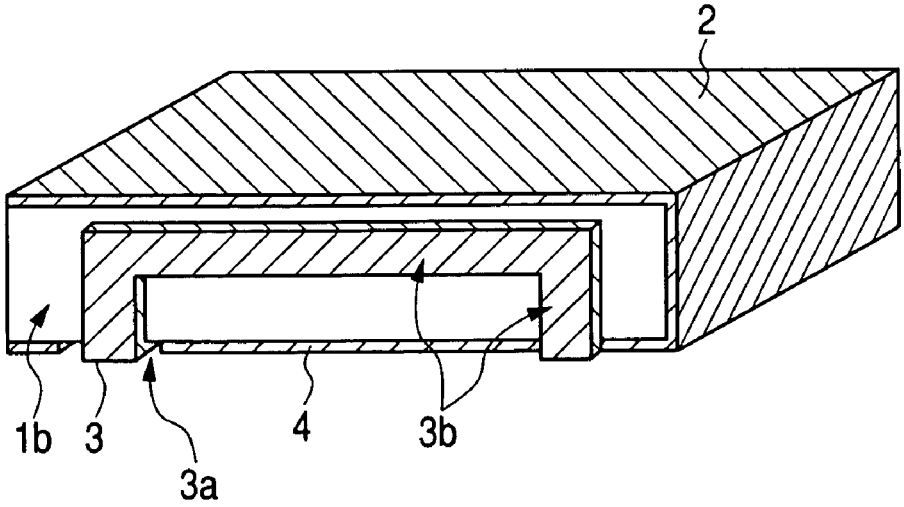
FIG. 3 is a perspective view of a surface-mounted antenna according to a third embodiment of the invention.
Figure 4A:
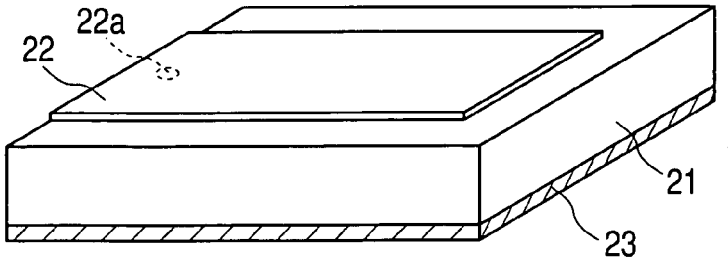
FIG. 4A is a perspective view of a related-art inverted-F antenna.
Figure 4B:
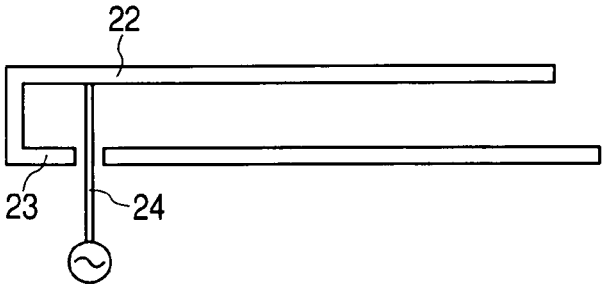
FIG. 4B is a side section view of the related-art inverted-F antenna.
Figure 5:
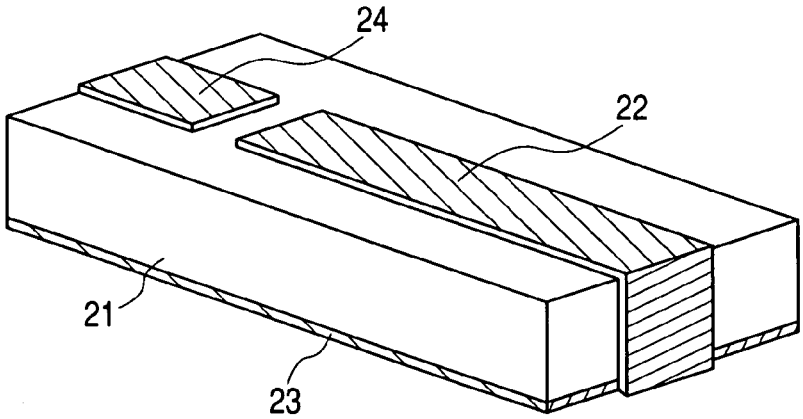
FIG. 5 is a perspective view of the related-art inverted-L antenna.

Further, as a third embodiment shown in FIG. 3, the feeding electrode 3 may be formed on only one side surface 1*b* of the dielectric substrate 1. Also in this figure, like or equivalent portions are designated by like reference numerals used in the first embodiment, and no further description on them will be given, for simplicity. As a not-shown embodiment, the feeding electrode 3 may be embedded in the dielectric substrate 1. In this case, the parallel portion of the feeding electrode 3 is formed vertically adjacent to the radiation electrode 2 which is formed on the surface of the dielectric body.

In the instance shown in FIG. 1, the feeding electrode 3 is provided while being confronted with the open end 2*a* of the radiation electrode 2. When a distance between the feeding electrode 3 and the radiation electrode 2 is selected to be large to thereby reduced the capacitive coupling therebetween, a major coupling of the feeding electrode 3 with the radiation electrode 2 is not established by only the part of the feeding electrode 3 which is confronted with the open end 2*a* from the radiation electrode 2. As a result, the coupling between them is more stabilized. Incidentally, the degree of the coupling of the feeding electrode 3 with the radiation electrode 2 is adjusted independently of an operation frequency of the feeding electrode 3 since a density of current flowing to the feeding electrode 3 and the magnetic coupling between them may be controlled by adjusting the distance between the feeding electrode 3 and the radiation electrode 2.

The ground electrode 4 occupies substantially the one entire surface of the dielectric substrate 1, which is opposite to the surface having the radiation electrode 2 formed thereon, except a portion of the surface thereof which is occupied by the feeding terminal 3*a*. The ground electrode 4, the radiation electrode 2 and the feeding electrode 3 may easily be formed on the surfaces of the dielectric substrate 1 in a manner that conductive films, such as silver films, are formed on predetermined surfaces of the dielectric substrate 1 by printing or vacuum deposition and patterning. In an alternative, conductive wires or plates of steel, for example, are arranged on the dielectric substrate 1. Further laminating dielectric sheets having conductive films thereon in such a condition, the radiation electrode 2, the feeding electrode 3 and the ground electrode 4 or any of those are formed in the dielectric substrate 1.

According to the above described configuration, a power feed signal from the feeding terminal 3*a* appears as current of the feeding electrode 3, and the current is maximized at the connection point to the ground electrode 4. A magnetic field developed by the current induces a current I in the parts of the radiation electrode 2 which is parallel to the feeding electrode 3 (regions A and B in FIG. 1). Then, the radiation electrode 3 is excited to emit a signal into the air. Also when a signal is received, the received signal appears in the feeding terminal. That is, the radiation electrode 2 is magnetically coupled to the feeding electrode 3 and excited, and thus an antenna operation is performed.

The surface-mounted antenna of the invention utilizes the magnetic induction coupling by the parallel portion of the line. Therefore, the antenna of the invention is theoretically free from the coupling loss by the dielectric loss and a variation of the coupling caused by the vicinal dielectric material. Since the one end of the feeding electrode 3 is grounded, an impedance in the lower frequency region is fixed at a low value. Accordingly, the antenna is stabilized in performance, and insensitive to static electricity. The magnetic induction coupling depends less on the coupling gap dimension than the capacitive coupling. Therefore, the characteristic is stable against a dimensional variation, and hence the antenna of the invention is excellent in mass production.

Further, since the feeding electrode 3 is provided near the open end 2*a* of the radiation electrode 2, a maximum current appears at the connection part of the feeding electrode 3 and the ground electrode 4. Accordingly, by setting a distance between the open end 2*a* of the radiation electrode 2 and the feeding electrode 3 to be large, the feeding electrode 3 and the radiation electrode 2 are electrically coupled mainly through the magnetic induction coupling. Some capacitive coupling can also be secured while avoiding the coupling loss by the dielectric loss and a variation of the coupling caused by the vicinal dielectric material. The coupling between them is dispersively carried out over a broader area. As a result, an extremely stable coupling is secured and the coupling control is made easy.

A circuit board incorporating a communication circuit and others is assembled into a case of a portable telephone or a portable terminal device. In this case, the antenna of the invention may be directly mounted on the circuit board. In this case, a ground conductor on the reverse side of a portion of the circuit board on which the antenna is mounted, is removed, and at least a portion of the case which is located in front of the antenna is formed so as to permit electromagnetic wave to pass therethrough. With such a structure, the resultant portable wireless device is excellent in antenna characteristic, small in size and high in performance.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An antenna, comprising:

a dielectric body;

a ground electrode, provided on a first surface of the dielectric body;

a radiation electrode, having a first end which is left open and a second end which is connected to and directly contacts the ground electrode;

a feeding terminal, provided on the first surface; and a feeding electrode, having a first end which is connected to and directly contacts the feeding terminal and a second end which is connected to and directly contacts the ground electrode, at least a first part of the feeding electrode being extended in parallel with an elongated direction of the radiation electrode, so as to excite the radiation electrode with an induction coupling in a non-contact manner.

2. The antenna as set forth in claim 1, wherein a part of the feeding electrode extends in the vicinity of the first end of the radiation electrode so as to establish a capacitive coupling therebetween.

3. The antenna as set forth in claim 1, wherein an electrical length of the first part of the feeding electrode is substantially equal to one fourth of a wavelength at an operation frequency of the antenna.

4. A portable wireless device, comprising a circuit board, on which a wireless communication circuit is provided, and the antenna as set forth in claim 1 is mounted.

5. The antenna as set forth in claim 1, wherein the radiation electrode is provided on the dielectric body so as to avoid the first surface.

6. The antenna as set forth in claim 1, wherein the radiation electrode is provided in the dielectric body.

* * * * *